United States Patent [19]

Kennedy et al.

[11] Patent Number: 4,573,943

[45] Date of Patent: Mar. 4, 1986

[54] MOTORIZED TOY VEHICLE

[75] Inventors: Melvin R. Kennedy, New York, N.Y.; Dietmar Nagel, Chester, N.J.; Abraham A. Arad, Westport, Conn.

[73] Assignee: Buddy L Corporation, New York, N.Y.

[21] Appl. No.: 683,045

[22] Filed: Dec. 18, 1984

[51] Int. Cl.[4] ..... A63H 29/24

[52] U.S. Cl. ..... 446/463; 446/443

[58] Field of Search ..... 446/443, 457, 461, 462, 446/463, 465

[56] References Cited

U.S. PATENT DOCUMENTS

| | | | |
|---|---|---|---|
| 2,697,306 | 12/1954 | Müller | 446/443 |
| 3,503,151 | 3/1970 | White et al. | 446/443 |
| 3,818,632 | 6/1974 | Tong | 446/443 |
| 4,152,866 | 5/1979 | Suda | 446/463 |
| 4,488,375 | 12/1984 | Cheng | 446/443 |
| 4,498,887 | 2/1985 | Cook | 446/462 |

FOREIGN PATENT DOCUMENTS

| | | | |
|---|---|---|---|
| 2229780 | 1/1974 | Fed. Rep. of Germany | 446/457 |

*Primary Examiner*—Robert A. Hafer
*Assistant Examiner*—Daniel Nolan
*Attorney, Agent, or Firm*—Michael Ebert

[57] ABSTRACT

A toy vehicle propelled by a bi-directional, miniature d-c motor, coupled by a clutch through a gear train to a wheel axle. A manually-operated shift stick mechanism is operatively linked both to the clutch and to a polarity-reversing switch interposed between the motor and a battery. The arrangement is such that when the stick is in neutral, the battery is disconnected and the clutch is disengaged, whereby the vehicle is then free rolling. When the stick is put in its forward position, the clutch is engaged to couple the motor to the gear train and the switch is operated to apply voltage to the motor in a polarity causing the vehicle to travel in the forward direction. When the stick is put in its reverse position, the clutch is again engaged and the switch is operated to apply voltage to the motor in the reverse polarity, causing the vehicle to travel in the opposite direction.

2 Claims, 7 Drawing Figures

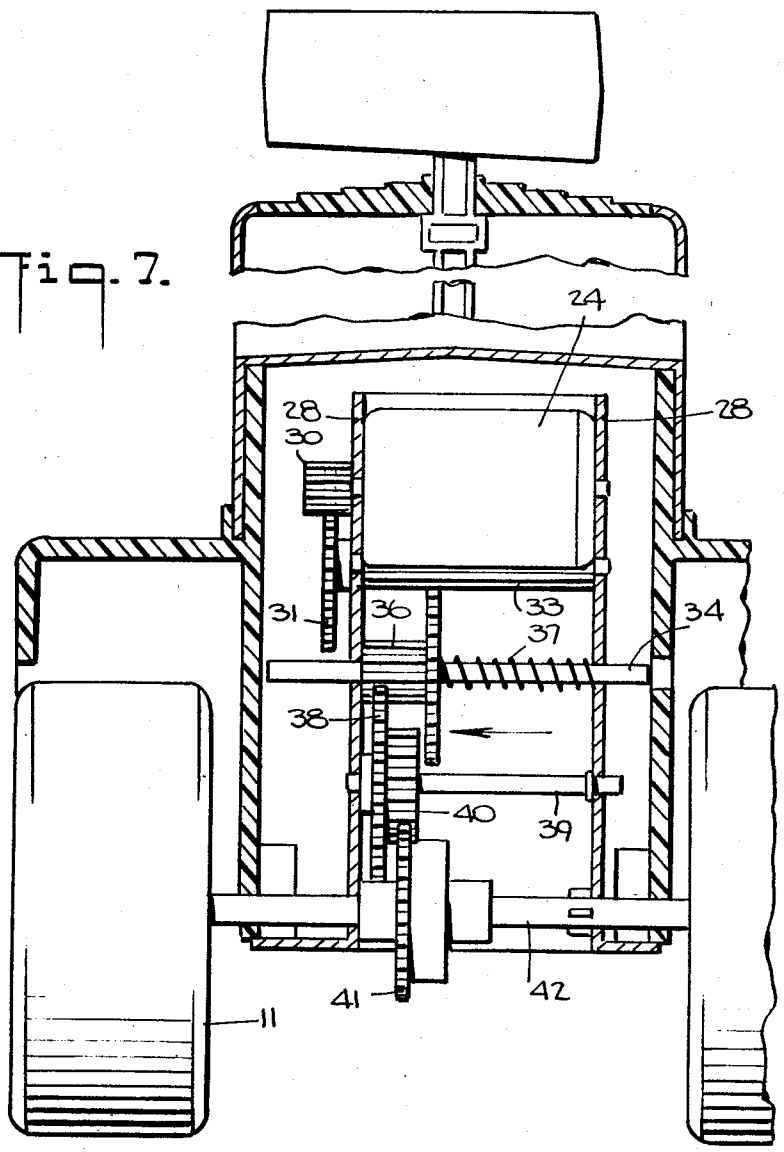
Fig. 7.
Fig. 6.
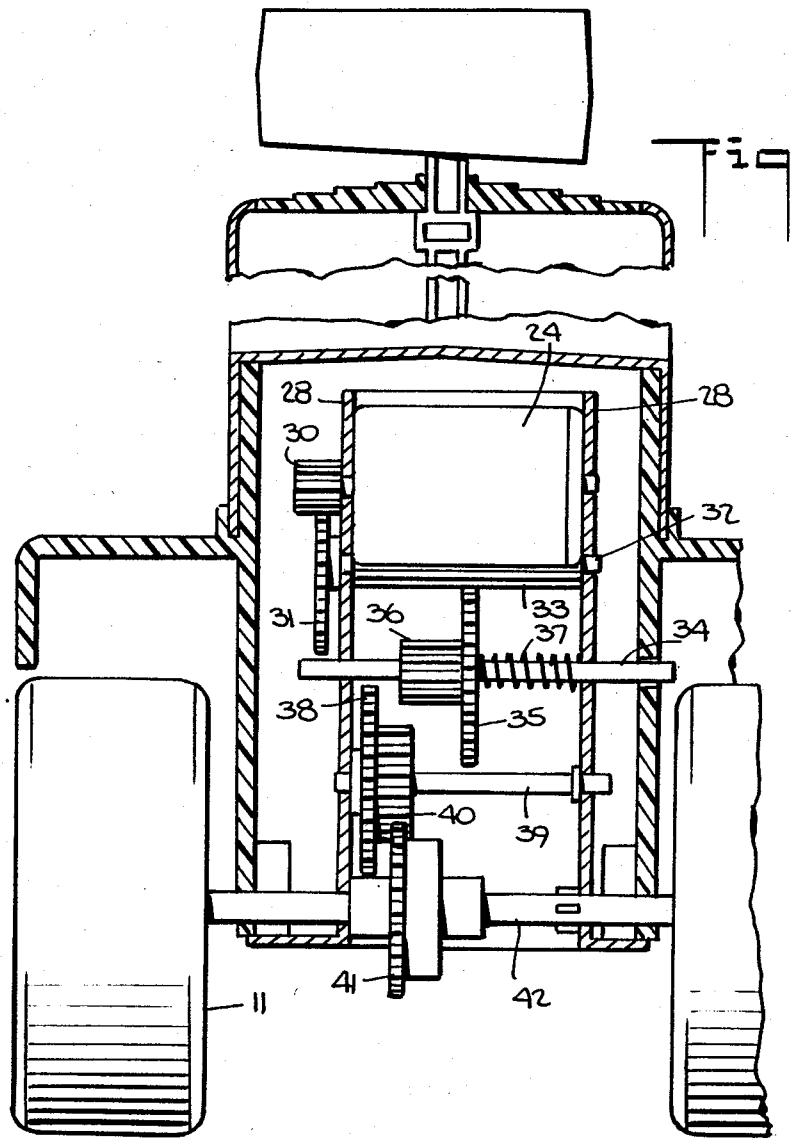

MOTORIZED TOY VEHICLE

BACKGROUND OF INVENTION

1. Field of Invention

This invention relates generally to electrically-powered toy vehicles, and more particularly to a toy vehicle propelled in either the forward or reverse direction by a bi-directional miniature d-c motor through a clutch and polarity-reversing switch operated by a shift stick mechanism, the vehicle being free rolling when the stick is in neutral.

2. Prior Art

The most effective toys in terms of play value and sustained interest on the part of the player are those that simulate real-life adult activity. Thus a toy vehicle is more attractive to a child when it has the appearance of a familiar, full-scale, adult vehicle. The toy vehicle is even more appealing to the child if the vehicle performs and can be operated in a manner comparable to the adult version, for then the child can play-act the role of an adult.

The use of bidirectional d-c motors to propel toy vehicles is known. In such toys, the motor is coupled to a battery through a polarity-reversing switch, such that when the switch is in one position, the motor provides forward travel, and when the switch is in another position, the motor drives the vehicle in the reverse direction.

Since real life vehicles such as trucks and autos are not operated by electrical switches, a conventional motorized toy vehicle fails to simulate the operating controls of a standard which makes use of a shift stick operating a gear shift mechanism to effect forward or reverse operation.

Another drawback of existing motorized vehicles is that the miniature electric motor is always coupled to a wheel axle and the vehicle is therefore never free rolling. A child playing with a motorized toy vehicle may, on occasion, wish to propel the vehicle by hand rather than by motor in order to carry out some imaginative play activity. But with known types of motorized toy vehicles, unless the motor is energized, the vehicle cannot be propelled.

SUMMARY OF INVENTION

In view of the foregoing, the main object of this invention is to provide a toy vehicle propelled by a bi-directional miniature d-c motor through a clutch and a polarity-reversing switch operated by a shift stick mechanism in either the forward or reverse direction, the vehicle being free rolling when the stick is in neutral.

More particularly, an object of this invention is to provide a toy vehicle of the above type which is operated in a manner simulating the operating controls of a real-life vehicle, whereby the player is able to imitate adult activity.

Also an object of the invention is to provide a motorized toy vehicle which operates efficiently and reliably and which may be manufactured at relatively low cost.

Briefly stated, these objects are attained in a toy vehicle propelled by a bi-directional, miniature d-c motor, coupled by a clutch through a gear train to a wheel axle. A manually-operated shift stick mechanism is operatively linked both to the clutch and to a polarity-reversing switch interposed between the motor and a battery. The arrangement is such that when the stick is in neutral, the battery is disconnected and the clutch is disengaged, whereby the vehicle is then free rolling. When the stick is put in its forward position, the clutch is engaged to couple the motor to the gear train and the switch is operated to apply voltage to the motor in a polarity causing the vehicle to travel in the forward direction. When the stick is put in its reverse position, the clutch is again engaged and the switch is operated to apply voltage to the motor in the reverse polarity, causing the vehicle to travel in the opposite direction.

OUTLINE OF DRAWINGS

For a better understanding of the invention as well as other objects and further features thereof, reference is made to the following detailed description to be read in conjunction with the accompanying drawings, wherein.

Figure 3:
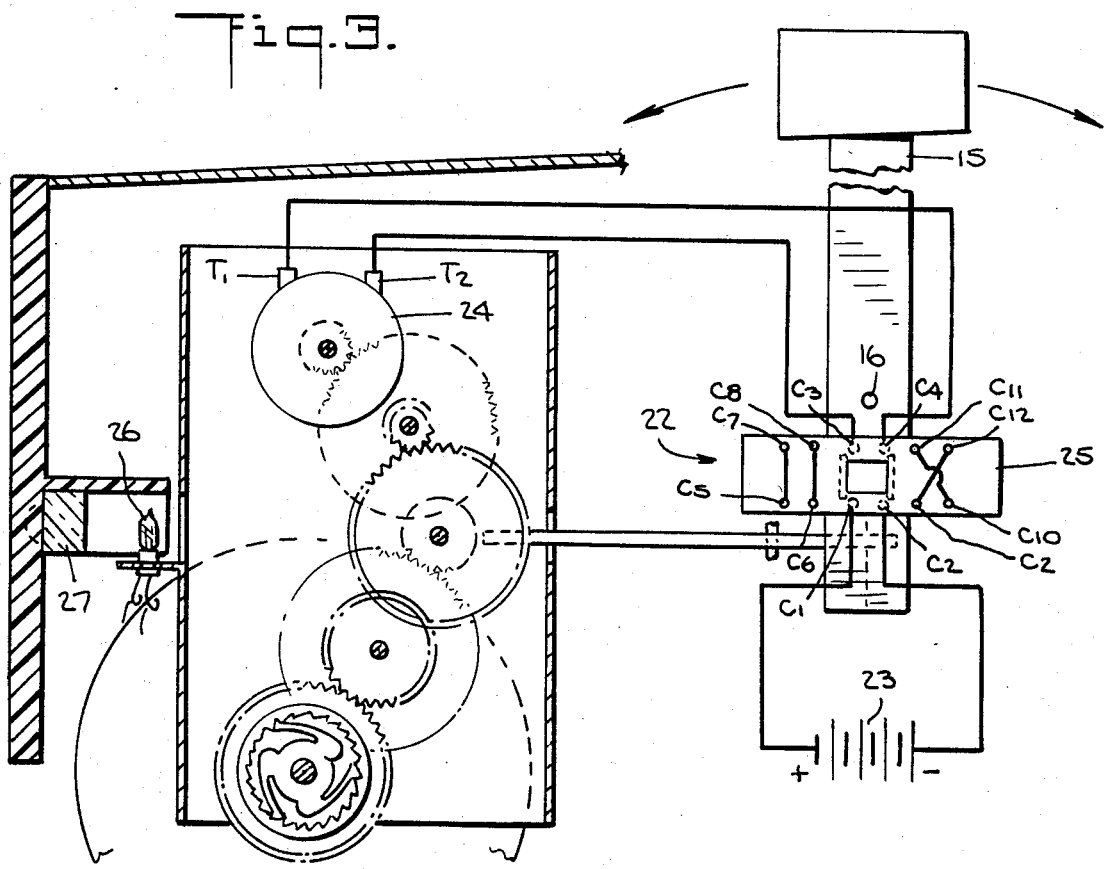
Figure 4:
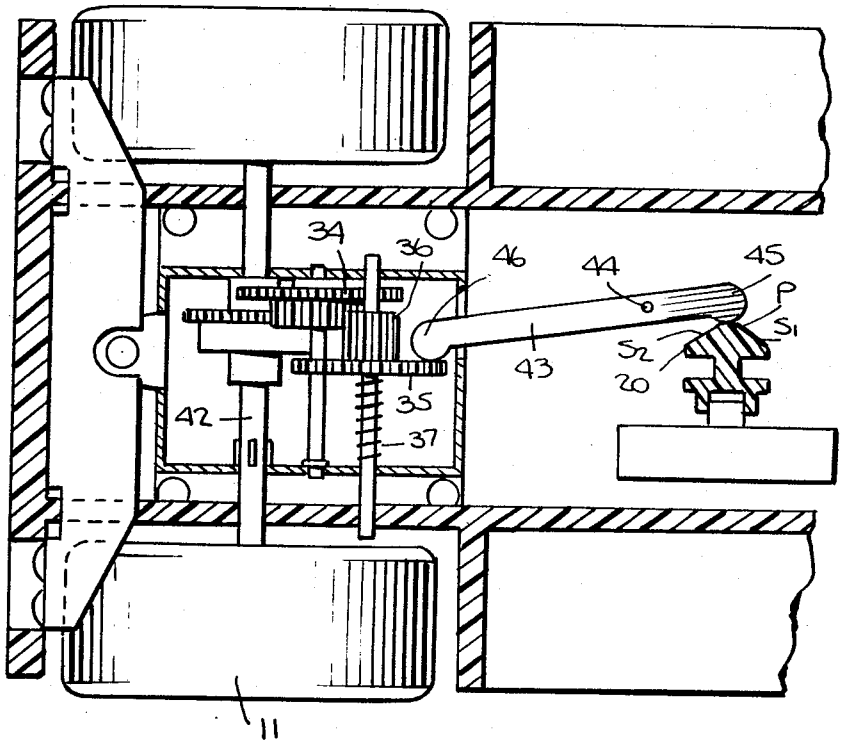
Figure 5:
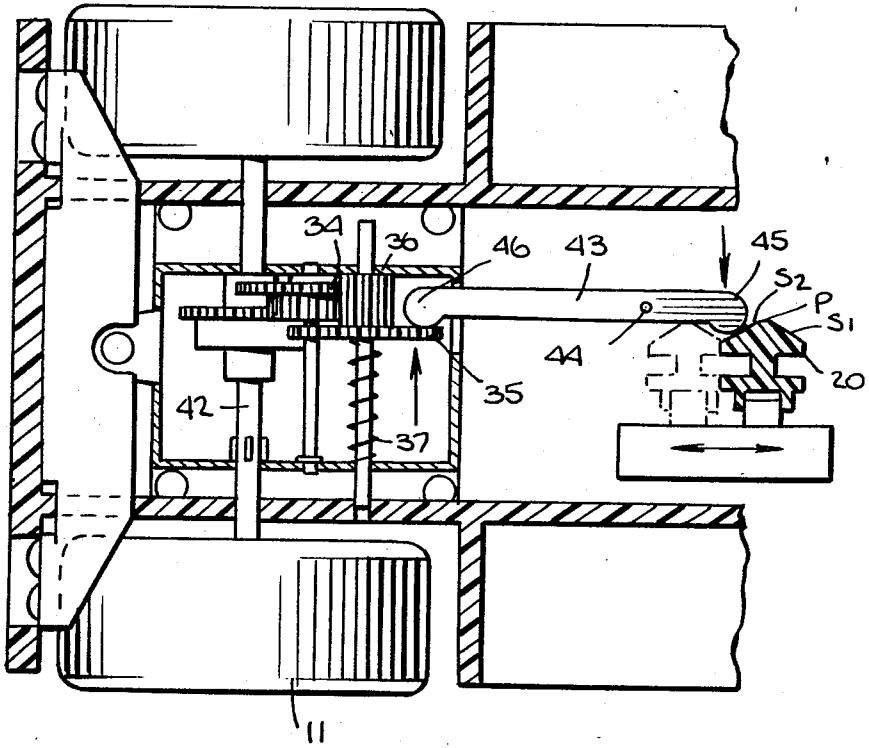

FIG. 3 schematically illustrates the polarity-reversing switch associated with the motor of the vehicle;

FIG. 4 is a longitudinal section taken through the vehicle chassis and the mechanism supported thereby, with the clutch in its disengaged state;

FIG. 5 is the same as FIG. 4, but with the clutch engaged;

FIG. 6 is a transverse section taken through the mechanism when the clutch is disengaged; and FIG. 7 is the same as FIG. 6, but with the clutch engaged.

DESCRIPTION OF INVENTION

Figure 1:
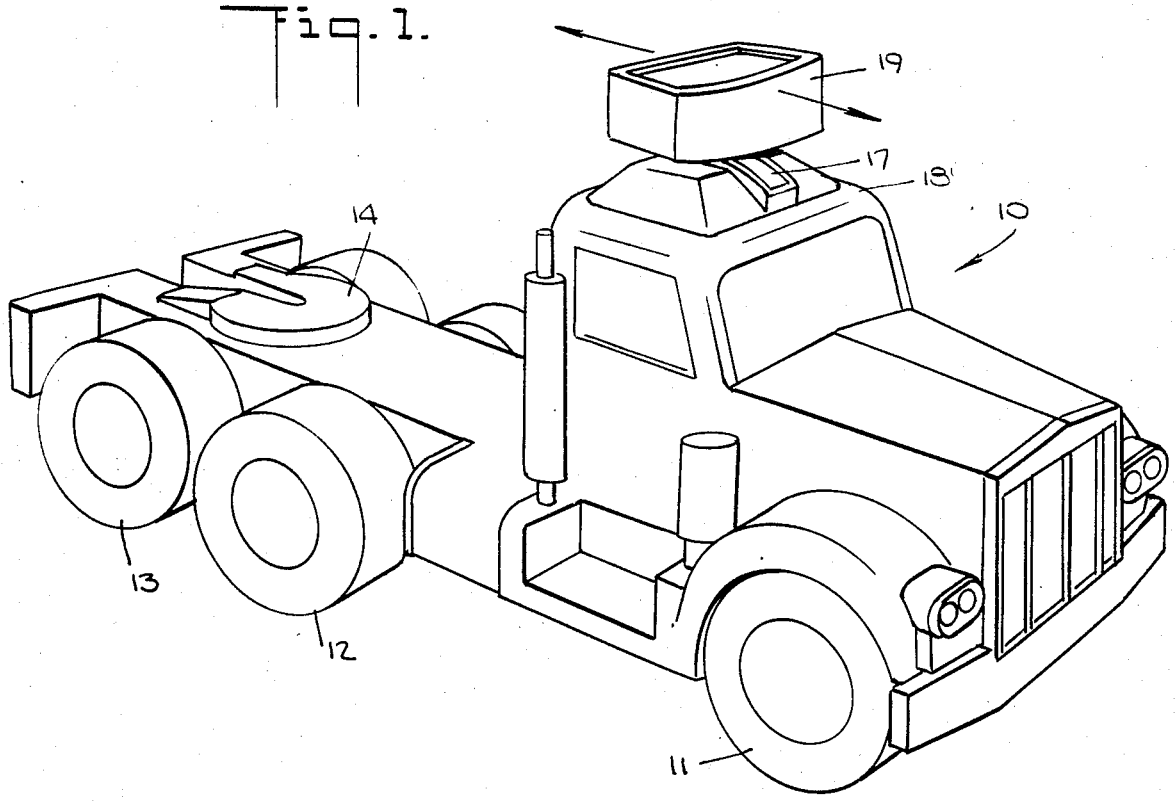
FIG. 1 is a perspective view of a motorized toy vehicle in accordance with the invention.

Referring now to FIG. 1, there is shown a toy tractor truck 10 in accordance with the invention having a set of front wheels 11 and two sets of rear wheels 12 and 13. Also provided is a so-called fifth wheel 14 adapted to socket the coupling pin of a trailer (not shown). This tractor truck is shown only by way of one example of a motorized toy vehicle in accordance with the invention, for the mechanisms involved may be incorporated in various other forms of motorized toy vehicles, such as pick-up trucks or fire engines.

Figure 2:
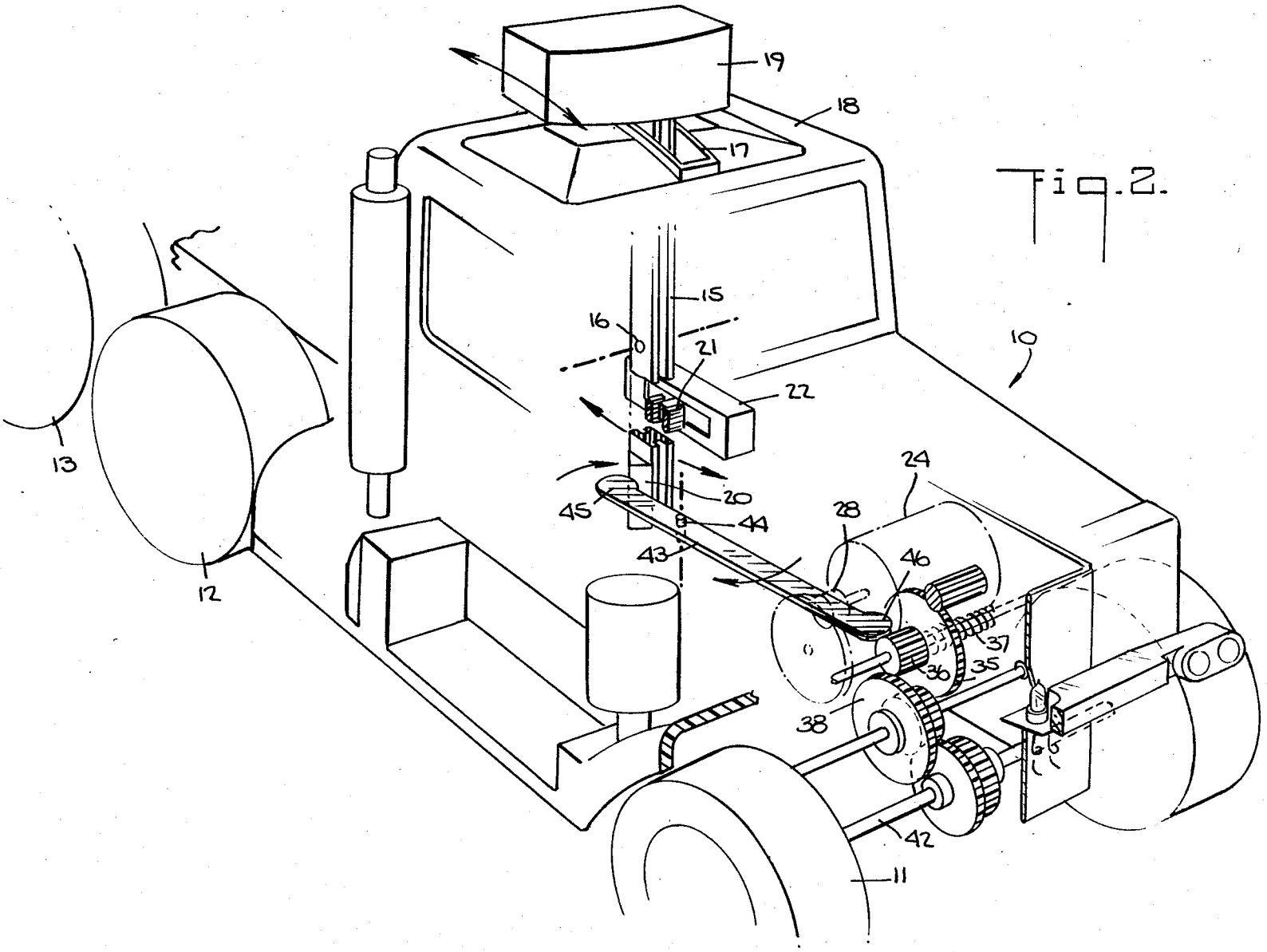
FIG. 2 is a view of the same vehicle, but with the body in phantom to expose the internal mechanism.

The manual control for the vehicle takes the form of a shift stick 15 which is pivoted at point 16 to function as a lever. The upper end of stick 15 extends through an arcuate slot 17 in the roof of the cab 18 and terminates in a handle 19. In FIGS. 1 and 2, the shift stick is shown in its neutral position, the stick being swingable within slot 17 to either a forward or reverse position, as indicated by the arrows.

The lower end of stick 15 is joined to a cam head 20 having a triangular cross section. The head formation defines a peak P and slopes $S_1$ and $S_2$ on either side thereof, as best seen in FIGS. 4 and 5.

At a position between pivot 16 and cam head 20, stick 15 is operatively linked to the actuator 21 of a polarity-reversing switch 22. This switch is interposed, as shown in FIG. 3, between a battery supply 23 and a miniature bi-directional d-c motor 24 so that when the actuator is pushed to one side, the voltage is applied to the motor in one polarity, and when the actuator is pushed to the other side, the polarity of the applied voltage is reversed.

Polarity-reversing switch 22, as shown in FIG. 3, includes two pairs of fixed contacts at the corners of a rectangle, the first pair $C_1$–$C_2$ being connected to battery 23; the second pair $C_3$–$C_4$ to the motor terminals $T_1$ and $T_2$. These fixed contacts cooperate with a movable component in the form of a slide 25 of insulating material which is shiftable by its actuator in either direction with respect to the fixed contact rectangle. The slide is shown in its neutral position in which the midline of the slide is equidistant from the fixed contacts on either side thereof.

Slide 25 carries two sets of contact pairs on either side of its midline. One set is composed of contact pairs $C_5$–$C_6$ and $C_7$–$C_8$ at the corners of a rectangle corresponding to the fixed contact rectangle, the other set being similarly composed of contact pairs $C_9$–$C_{10}$ and $C_{11}$–$C_{12}$.

In the first set of contact pairs on slide 25, contact $C_5$ of one pair is connected to contact $C_7$ of the other pair, while contact $C_6$ is connected to contact $C_8$, so that these pairs are in parallel relation. In the second set, contact $C_9$ of one pair is connected to contact $C_{12}$ of the other pair and contact $C_{10}$ is connected to contact $C_{11}$, so that the pairs in this set are cross connected.

When the slide is shifted to the left by shift stick 15, fixed contacts $C_1$ and $C_2$ are engaged by slide contacts $C_5$ and $C_6$, and fixed contacts $C_3$ and $C_4$ are engaged by slide contacts $C_7$ and $C_8$, respectively. Hence the "+" terminal of battery 60 is applied to input terminal $T_2$ of motor 24 and the "−" terminal is applied to input terminal $T_1$, causing the motor to run in one direction.

When the slide 25 is shifted to the right, fixed contacts $C_1$ and $C_2$ are engaged by slide contacts $C_9$ and $C_{10}$, and fixed contacts $C_3$ and $C_4$ by slide contacts $C_{11}$ and $C_{12}$, thereby applying the "+" terminal of the battery to motor terminal $T_1$ and the "−" terminal to motor terminal $T_2$, causing the motor to turn in the opposite direction. The invention is not limited to any particular form of polarity-reversing switch, and any switch of this type may be used as long as it can be linked to a shift stick.

A lamp 26 is connected by leads across motor terminals $T_1$ and $T_2$. Lamp 26 is associated with a light guide 27 of clear plastic (i.e., acrylic) material which is molded to define a pair of headlights for the vehicle. This lamp 26 is turned on whenever the motor is energized in either polarity.

Motor 24, which is in cylindrical form, is supported between the parallel side panels 28 and 29 of a box-like frame which fits within the chassis of the vehicle. As best seen in FIGS. 7 and 8, the armature shaft of the motor which extends through a bore in panel 28 has a drive gear 30 secured thereto. Drive gear 30 engages a coupling gear 31 on one end of an axle 32 which extends between panels 28 and 29 and is supported in bores therein acting as bearings at a position parallel to the motor shaft.

Mounted on axle 32 between the panels is an elongated motor output gear 33 which when the motor operates turns at a rate determined by the gear ratio of drive gear 30 to coupling gear 31.

A clutch mechanism is provided between the motor output gear 33 and a gear train coupled to a wheel axle. This mechanism is constituted by a clutch gear 35 which is axially shiftable along a shaft 34 bridging panels 28 and 29 in parallel relation to axle 32. Clutch gear always meshes with the elongated motor output gear 33 regardless of its axial position.

On one face of clutch gear 35 is a pinion 36, the other face being engaged by a helical spring 37 wound on shaft 34. This spring urges the clutch gear to move axially on shaft 34 toward the left, as indicated by the arrow in FIG. 7.

When this axial shift of the clutch gear is not impeded, pinions 36 of the clutch gear is brought into mesh with the input gear 38 of a gear train, gear 38 being mounted on an axle 39 extending between the frame panels in parallel to the clutch shaft.

The gear train further includes an intermediate gear 40 mounted on axle 39 which meshes with a final gear 41 mounted on the axle 42 for the front wheels 11. Thus when the clutch is engaged and the motor is energized, the rotating motor output gear 33 through the clutch drives the gear train to turn the front wheels in a direction determined by the polarity of voltage applied to the motor.

When the clutch is disengaged, the gear train for the front wheel axle is decoupled from the motor and the wheels are then free rolling, so that the player can move the vehicle, as he pleases, by hand.

The linkage between the shift stick 15 and the clutch is by way of a horizontal lever 43 which is swingable on a pivot pin 44. A cam follower 45 is formed on one end of lever 43 which runs on the surface of cam head 20 attached to the lower end of the stick. The other end of the lever has a finger 46 formed thereon which engages the face of clutch gear 35 carrying pinion 46, the opposite face being engaged by spring 37.

At the neutral position of shift stick 15, as shown in FIGS. 2 and 4, the cam follower 45 of lever 43 rests on peak P of cam head 20 at the end of the stick, this action causing the lever to swing. This swing causes finger 46 on the other end of the lever to push the face of clutch gear 35 against the action of spring 37 to axially shift the clutch gear on shaft 34, and thereby disengage pinion 36 from gear train input gear 38.

When, however, the shift stick is in its forward position, the cam follower 45, as shown in FIG. 5, then rests on slope $S_2$, and when the stick is in its reverse position, the cam follower 45 then rests on the slope $S_1$ on the opposite side of peak P. In either case, lever 43 assumes a position in which finger 46 no longer presses the clutch gear 35 to effect disengagement, and the clutch pinion 36 then engages the gear train input gear 34, whereby the motor is operatively coupled to the gear train to drive the front wheel axle.

Thus the shift stick when either in the forward or reverse position is so linked to the clutch that the clutch acts to couple the motor output gear to the gear train to drive the front wheel in a direction determined by the polarity of battery voltage applied to the motor. In the forward position of the stick, the polarity-reversing switch applies the voltage to the motor in a polarity producing forward motion, and in the reverse position, the switch polarity is reversed to effect reverse motion.

And, as explained previously, in the neutral position of the stick, the battery is disconnected from the motor and the clutch is disengaged, so that the vehicle is then free-rolling. Hence, while the shift stick appears to behave in the manner of a conventional stick in a standard vehicle, it does not operate a gear shift mechanism, but operates both a polarity-reversing switch and a clutch to simulate the action of this mechanism.

While there has been shown a preferred embodiment of MOTORIZED TOY VEHICLE in accordance with the invention, it will be appreciated that many changes and modifications may be made therein without, however, departing from the essential spirit thereof.

We claim:

1. A toy vehicle provided with a set of wheels mounted on an axle, said vehicle comprising:

(A) a bi-directional d-c motor operatively coupled to the wheel axle through a clutch which is engageable to cause the axle to turn in a direction determined by the polarity of the voltage applied to the motor, said motor being provided with an elongated output gear which is coupled by the clutch to an input gear of a gear train whose final gear is mounted on the wheel axle, said clutch being constituted by a clutch gear axially shiftable on a shaft and engaging said elongated motor output gear regardless of its axial position, said clutch gear having a pinion on one face thereof which engages its input gear on the gear train only when said clutch gear is urged by a spring pressing against its other face into an axial position affecting such engagement;

(B) an independent polarity-reversing switch provided with an actuator connecting a battery to the motor, said switch being shiftable from a neutral position in which the battery is disconnected from the motor to either a forward position in which the battery is connected to the motor in one polarity or a reverse position in which the battery is connected to the motor in the opposite polarity; and (C) a shift stick mechanism operatively linked both to the clutch and to the actuator of the switch so that when the stick is in its neutral position, the switch is in the corresponding position and the clutch is disengaged whereby the vehcile then free rolling; and when the stick is in its forward position, the switch is in the corresponding position and the clutch is then engaged to drive the wheels in the forward direction; and when the stick is in its reverse position, the switch is in the corresponding position and the clutch is then engaged to drive the wheels in the reverse direction; said shift stick mechanism including a cam head on one end of the stick engaged by a cam follower on one end of a pivoted lever on whose other end is a finger which engages the face of the clutch gear, said head having a peak and slopes on either side thereof whereby when the cam follower rests on the peak in the neutral position of the stick and of the switch, it swings the lever to cause the finger to effect disengagement of the clutch gear.

2. A vehcicle as set forth in claim 1, wherein said stick extends through the roof of the vehicle in a slot therein and has a handle attached thereto.

* * * * *